United States Patent [19]

Pappas et al.

[11] Patent Number: 4,531,251

[45] Date of Patent: Jul. 30, 1985

[54] MOP HOLDER

[76] Inventors: George Pappas, 315 Wynsum Ave., Merrick, N.Y. 11566; Archimedes M. Perdios, 169 Traymore Blvd., Island Park, N.Y. 11558

[21] Appl. No.: 512,374

[22] Filed: Jul. 11, 1983

[51] Int. Cl.[3] ..... A47L 13/24

[52] U.S. Cl. ..... 15/147 R; 15/171; 15/229 A

[58] Field of Search ..... 15/146, 147 R, 147 A, 15/147 C, 149, 150, 151, 153, 228, 229 A, 229 AP, 229 B, 229 BP, 147 B, 147 D, 202, 171, 168

[56] References Cited

U.S. PATENT DOCUMENTS

| | | | |
|---|---|---|---|
| D. 206,996 | 2/1967 | Blount | 15/202 X |
| 874,368 | 12/1907 | McAtlin | 15/171 |
| 1,223,464 | 4/1917 | Andersch et al. | 15/153 |
| 1,414,037 | 4/1922 | Meinhardt | 15/147 R |
| 1,806,402 | 5/1931 | Lorang | 15/229 A |
| 1,956,142 | 4/1934 | Brohasek et al. | 15/171 X |
| 2,490,159 | 12/1949 | Ricchiuti | 15/202 |
| 2,558,290 | 6/1951 | Brown et al. | 15/202 |
| 2,610,354 | 9/1952 | Howell | 15/202 X |
| 2,860,361 | 11/1958 | Moody | 15/202 X |
| 3,328,822 | 7/1967 | Sellesi | 15/229 A |
| 3,398,419 | 8/1968 | Carlos | 15/146 X |
| 3,457,581 | 7/1969 | Oas | 15/147 R |

FOREIGN PATENT DOCUMENTS

| | | | |
|---|---|---|---|
| 1495616 | 8/1967 | France | 15/171 |
| 561829 | 4/1957 | Italy | 15/171 |

*Primary Examiner*—Edward L. Roberts

*Attorney, Agent, or Firm*—Kane, Dalsimer, Kane, Sullivan and Kurucz

[57] ABSTRACT

A mop holder includes a support structure having an internally threaded receptacle means to receive and removably secure a handle thereto. The support structure includes a base plate having a plurality of projecting studs which are inserted through apertures in the backing material of a mop head. The backing plate also includes an internally threaded boss. A cover plate is placed upon the backing plate of the support structure. The cover plate includes apertures along its front edge aligned to receive the studs of the backing plate. A knurled screw is inserted through an aperture in the cover plate and threadingly engaged to the threaded boss of the backing plate thereby securing the cover plate to the backing plate and securing the mop head therebetween.

8 Claims, 3 Drawing Figures

MOP HOLDER

BACKGROUND OF THE INVENTION

The present invention pertains to mop holders.

At present mops comprise a series of string elements that are attached to a back support. The mop strings and the back support generally must be threaded about a supporting transverse rod which forms a part of a mop holder. The mop holder includes a mop handle that is generally formed integral with the mop holder. Hence, when the mop handle breaks or bends or becomes incapacitated, the whole of the mop holder structure is useless and must be discarded. The handle takes a great deal of abuse and has applied to it all of the rotative, torsional and bending forces when the mop is in use. As a consequence, the handle tends to break more readily than the remaining supporting mop holder structure that retains the mop in position.

Additionally, at present mops generally include protruding parts such as nuts, bolts and sharp edges which result in surfaces contacted by these parts being scraped or mop head strands becoming tangled thereon.

Mop holders have generally been simple structures designed to keep costs low without adequately dealing with the problems of ease of mop head replacement, firmly securing the mop head to the mop holder, minimizing protruding parts and edges, and providing for a detachable handle.

SUMMARY OF THE INVENTION

The present invention involves a mop holder having a receptacle means adapted to receive and secure a handle thereto, a base plate having a plurality of studs attached to and extending from a front edge thereof, a cover plate adapted to overlay the backing plate maintaining a mop head therebetween, and a means for securing the cover plate to the backing plate.

This invention provides a unique support for the mop and also enables the mop handle to be purchased separately from the mop holder structure so that when the mop handle breaks it is merely necessary to replace the handle itself without disposing of the mop support structure. The handle receptacle is provided with a neck of sufficient length to enclose and support the section of the mop handle which is adjacent to the threaded portion of the handle, thereby reducing handle breaks during use.

The present mop holder provides in combination a manually detachable mop head and handle, and mop head engaging studs which are independent of and spaced from the means for securing the back plate to the cover plate.

The primary object of the present invention is to provide a mop holder structure which combines efficiency of use with ease and safety of use.

Another object is to provide a mop holder structure to be used in conjunction with a replaceable handle.

A further object is to provide a mop holder structure which allows manual replacement of the mop head.

A still further object is to provide a sturdy, long lasting mop holder structure.

Another object of the present invention is to provide a mop holder structure which eliminates sharp projections and edges which entangle mop head strands and scratch contacted surfaces so that the present mop holder structure may be safely used near delicate surfaces and furniture.

A further object is to provide a firm and longlasting mop head to support structure engagement by inserting the studs of the backing plate through the apertures (which may be reinforced by steel ring grommets) of the mop head backing.

Another object is to provide a means for securing the cover plate to the backing plate in which the screw threads are protected from contamination by the working liquid and dirt particles thereby maintaining ease of screw removal and mop head replacement.

These and other objects and advantages will become apparent from the following detailed description which is to be taken in conjunction with the accompanying drawings.

DETAILED DESCRIPTION OF THE PREFERRED EMBODIMENT

Figures 1, 2:
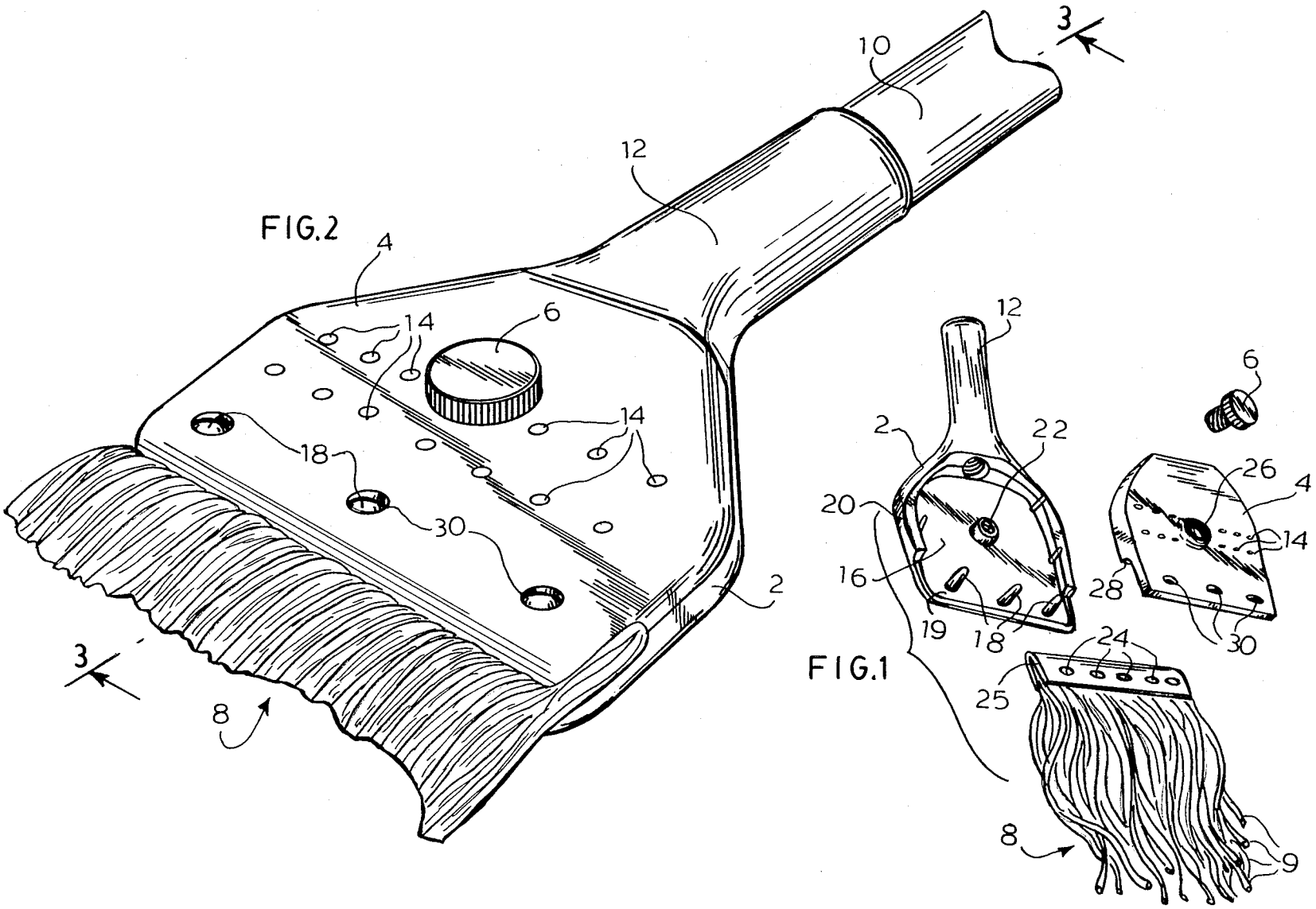
FIG. 1 is a perspective view of the present invention illustrating the support structure, the cover plate, the screw and the mop head prior to assembly.
FIG. 2 is a perspective view of the present invention as assembled.
Figure 3:
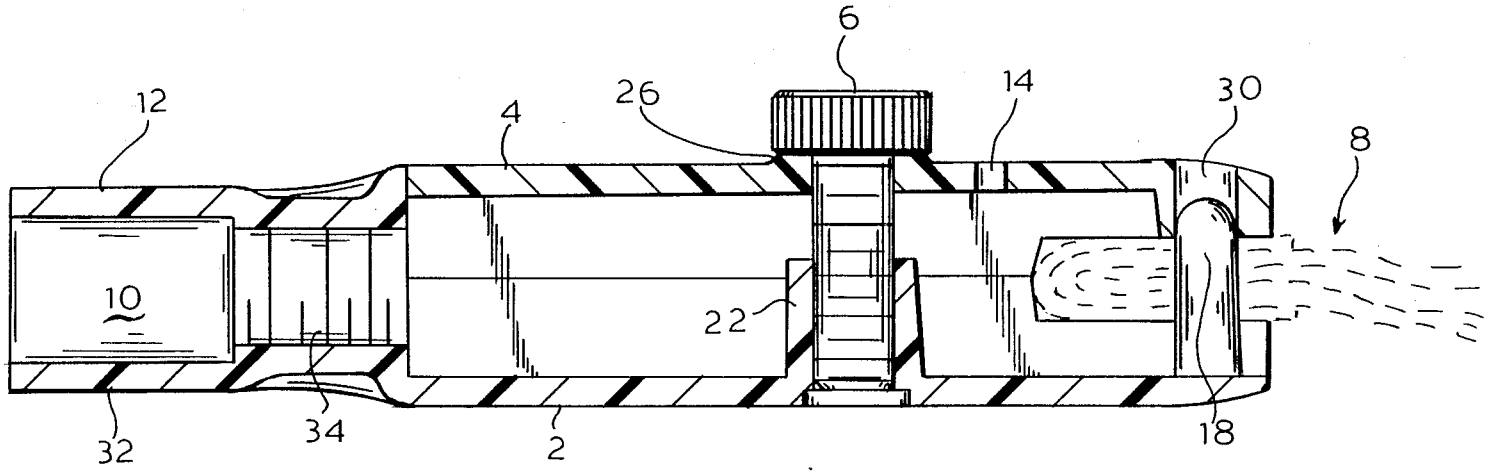
FIG. 3 is a section view of the present invention taken along line 3—3 of FIG. 2.

FIG. 1 illustrates support structure 2, cover plate 4, screw 6 and mop head 8 prior to assembly. The support structure and cover plate may be composed of any sufficiently sturdy material, a suitable resin such as polycarbonate can be used for such purposes.

Handle 10 is threadingly engaged to internally threaded receptacle means 12 having a support panel 32 to provide support to the handle during use, and threads 34. Alternately any convenient locking means for securing handle 10 to receptacle means 12 may be used.

Backing plate 16 is connected to receptacle means 12. Backing plate 16 provides a substantially flat surface having a plurality of studs 18 extending upwardly along front edge 19 of backing plate 16. Alternately studs 18 may be affixed to cover plate 4 and extend downwardly therefrom. The individual studs 18 may include slots or spaces therein to allow flexible contraction of the stud and to facilitate insertion into apertures 24 and apertures 30. The studs are spaced equal to the spacing of apertures 24 of mop head 8 and adapted to be matingly inserted through apertures 24 which are located on backing part 25 of mop head 8. When mop head 8 is mounted on studs 18, cover plate 4 may be mounted over the studs 18 to securely lock and retain the backing portion 25 of the mop to the support structure 2. Air holes 14 may be included on cover plate 4.

Cover plate 4 includes apertures 30 which are equally spaced with studs 18 and adapted to matingly receive studs 18 so that when cover plate 4 is secured to backing plate 16 studs 18 are inserted through apertures 30 of cover plate 4 as well as apertures 24 of mop head 8. Guide pins are provided along a rearward periphery of the backing plate to facilitate placement of cover 4 and to prevent lateral movement thereof.

Mop head 8 includes strands 9 which are bound by backing 25. Apertures 24 are spaced along backing 25 to correspond to studs 18 of backing plate 16. Apertures 24 may be reinforced by ring grommets.

Flanges 20 extend from stem 12 along the sides of backing plate 16. Flanges 28 of cover plate 4 extend from the back part of cover plate 4 along the sides of cover plate 4 and are adapted to form a line of contact with flanges 20 of backing plate 16 when cover plate 4 is secured to backing plate 16.

Integrally connected at a substantially central point on backing plate 16 is threaded boss 22. Threaded boss 22 is located so that it aligns with aperture 26 of cover plate 4 when cover plate 4 is mounted on backing plate 16. Screw 6, preferably a manually operable knurled screw, is inserted through aperture 26 and threaded into threaded boss 22 thereby maintaining cover plate 4 to backing plate 16. Any convenient alternative means for securing the cover plate to the backing plate may be used.

During regular use it may be desired to change the mop head for one of many reasons. Mop head 8 may be replaced by decoupling screw 6 removing cover plate 4 from backing plate 16, allowing mop head 8 to fall from the mop holder. A fresh mop head is then secured by inserting studs 18 through apertures 24, by mounting cover plate 4 onto backing plate 16, and screwing screw 6 into threaded engagement with threaded boss 22.

Having thus described the preferred embodiments of the invention, it should be understood that numerous structural modifications and adaptations may be resorted to without departing from the spirit of the invention.

What is claimed is:

1. A mop holder comprising;

a base plate;

a cover plate adapted to overlay the base plate, contacting the base plate along the sides thereof and defining an opening therebetween so that the base and cover plates act as a housing;

means for releasably securing the cover plate to the base plate;

a mop head disposed between the plates, provided with a plurality of holes;

a plurality of studs attached to the base plate along a front edge thereof, which extend through the holes in the mop head;

a plurality of apertures located on the cover plate and adapted to receive the studs of the base plate;

a receptacle means attached to the backing plate and adapted to removably receive and secure a handle thereto.

2. The invention in accordance with claim 1 wherein:

the base plate further includes a threaded boss;

the cover plate further includes an aperture which is adapted to receive a screw and is located so as to align with the threaded boss when the cover plate is mounted on the backing plate;

the means for securing the cover plate to the base plate comprises a screw inserted through the aperture in the cover plate and threadingly engaged to the threaded boss wherein the threads of the screw are located within the housing and the threaded boss so that they are protected from contamination and consequently provide unobstructed threading engagement.

3. The invention in accordance with claim 2 wherein the screw is a manually operable knurled screw.

4. The invention in accordance with claim 1 wherein:

the base plate further comprises a flange part extending away from the receptacle means along opposite edges of the base plate;

the cover plate is of the same width as the base plate and includes a corresponding flange part so that when the cover plate is mounted on the base plate the cover plate flange contacts the base plate flange creating a line of contact therebetween for the length of the flanges so that a seal is provided between the cover plate and the base plate.

5. The invention in accordance with claim 4 wherein the base plate further comprises a plurality of guide pins along a rearward periphery of the base plate, contiguous to the flange part of the base plate, the guide pins protruding above the flange part so that when the cover plate is mounted upon the base plate the guide pins are contiguous to an internal surface of the flange part of the cover plate thereby aligning the cover plate with the base plate and preventing lateral movement of the cover plate with respect to the base plate.

6. An apparatus for holding a mop comprising:

a support structure comprising:

a handle receptacle means in the shape of an elongated neck having internal threads so that an externally threaded mop handle may be detachably engaged therein;

a base plate attached to and extending from the receptacle means having a plurality of pins attached along a front edge and extending upwardly therefrom and having an internally threaded boss attached to the base plate at the center of the base plate, and having flanges along opposite edges of the base plate extending from the receptacle means, a cover plate of substantially the same length and width dimension as the base plate of the support structure, comprising:

an aperture in the center of the plate adapted to receive a screw and located so that when the cover plate is mounted on the base plate the aperture aligns with the threaded boss;

a plurality of apertures along a front edge of the cover plate aligned so that when the cover plate is mounted on top of the base plate the apertures align with and matingly receive the pins attached to the base plate;

flanges extending from a back part of the cover plate so that when the cover plate is placed on top of the backing plate the flanges contact the flanges of the base plate forming a seal therebetween, a knurled screw adapted to be fed through the aperture in the cover plate and threadingly engaged to the threaded boss of the base plate thereby securing the cover plate to the base plate.

7. An apparatus for holding a mop comprising:

a support structure comprising:

a handle receptacle means in the shape of an elongated neck having internal threads adapted to engage an externally threaded mop handle therein;

a base plate attached to and extending from the receptacle means having a plurality of pins attached along a front edge and extending upwardly therefrom and having an internally threaded boss attached to the base plate at the center of the base plate;

a cover plate of substantially the same length and width dimension as the base plate of the support structure, comprising;

an aperture in the center of the plate adapted to receive a screw and located so that when the cover plate is mounted on the base plate the aperture aligns with the threaded boss;

a plurality of apertures along a front edge of the cover plate aligned so that when the cover plate is mounted on top of the base plate the apertures align with, and matingly receive, the pins attached to the base plate;

a knurled screw adapted to be fed through the aperture in the cover plate and threadingly engaged to the threaded boss of the base plate thereby securing the cover plate to the base plate.

8. An apparatus for holding a mop comprising:

a support structure comprising:

a handle receptacle means in the shape of an elongated neck having internal threads adapted to engage an externally threaded mop handle therein;

a base plate attached to and extending from the receptacle means having a plurality of pins attached along a front edge and extending upwardly therefrom and having a screw receiving means attached to the base plate at the center of the base plate;

a cover plate of substantially the same length and width dimension as the base plate of the support structure, comprising;

an aperture in the center of the plate adapted to receive a screw and located so that when the cover plate is mounted on the base plate the aperture aligns with the screw receiving means;

a plurality of apertures along a front edge of the cover plate aligned so that when the cover plate is mounted on top of the base plate the apertures align with, and matingly receive, the pins attached to the base plate;

a screw adapted to be fed through the aperture in the cover plate and threadingly engaged to the screw receiving means of the base plate thereby securing the cover plate to the base plate.

* * * * *